US006314582B1

(12) United States Patent
Montague

(10) Patent No.: US 6,314,582 B1
(45) Date of Patent: Nov. 13, 2001

(54) WIND-RESISTANT WASHABLE HAT AND METHOD OF MANUFACTURE

(76) Inventor: Melissa Montague, 3308 Hidalgo St., Irving, TX (US) 75062

( * ) Notice: Subject to any disclaimer, the term of this patent is extended or adjusted under 35 U.S.C. 154(b) by 0 days.

(21) Appl. No.: 09/490,665

(22) Filed: Jan. 24, 2000

(51) Int. Cl.[7] ..... A42B 1/00
(52) U.S. Cl. ..... 2/175.3
(58) Field of Search ..... 2/175.1, 209.11, 2/171, 181, 183, 195.2, 209.12, 195.1, 195.4, 195.5, 195.6, 195.7, 175.2, 417, 418, 175.3

(56) References Cited

U.S. PATENT DOCUMENTS

| | | | | |
|---|---|---|---|---|
| 1,238,615 | | 8/1917 | Wolf . | |
| 1,342,132 | | 6/1920 | Peters . | |
| 3,842,436 | * | 10/1974 | Hirschson | 2/157 |
| 3,908,199 | * | 9/1975 | Lim | 2/175 |
| 4,096,590 | | 6/1978 | Keshock | 2/180 |
| 4,450,196 | * | 5/1984 | Kamat | 428/197 |
| 4,551,860 | * | 11/1985 | Smit et al. | 2/175 |
| 4,993,079 | * | 2/1991 | Johnson | 2/181 |
| 5,159,720 | * | 11/1992 | Scott, Jr. | 2/175 |
| 5,369,808 | * | 12/1994 | Brewer et al. | 2/175.3 |
| 5,488,740 | * | 2/1996 | Garza | 2/175.1 |
| 5,579,540 | * | 12/1996 | Walker | 2/209.11 |
| 6,012,172 | * | 1/2000 | Steffy | 2/175.1 |

* cited by examiner

*Primary Examiner*—John J. Calvert
*Assistant Examiner*—Katherine Moran
(74) *Attorney, Agent, or Firm*—Gardere Wynne Sewell LLP; Daniel J. Chalker

(57) ABSTRACT

The present invention provides a hat and a method for manufacturing a hat comprising a top, a band and a brim. The band has an upper portion and a lower portion, the upper portion of the band is attached to the perimeter of the top. The brim is attached to the lower portion of the band. The brim comprises a fusing material disposed between a first brim layer and a second brim layer to bond the first brim layer to the second brim layer.

21 Claims, 4 Drawing Sheets

WIND-RESISTANT WASHABLE HAT AND METHOD OF MANUFACTURE

TECHNICAL FIELD OF THE INVENTION

The present invention relates in general to hats, and in particular, to a wind-resistant washable hat and method of manufacture.

BACKGROUND OF THE INVENTION

Hats are becoming more popular in everyday use, especially during sporting and recreational activities. This is partly due to increased awareness of the health effects of ultraviolet light. Thus, hats provide protection from the sun and rain. Hats may also be purchased for aesthetic reasons. Despite the benefits provided by hats, hats are susceptible to being blown off by the wind. Several methods of more permanently affixing the hat to the head have been implemented. Chin straps secure some hats, but straps may be uncomfortable for the wearer and aesthetically unpleasing.

Another solution, which is popular with women's hats, is hat pins. Hat pins are designed to secure the hat to the wearer's hair by piercing through the hat, capturing a layer of hair, and re-piercing the hat. The layer of hair becomes trapped between the shaft of the pin and the hat, which results in fastening the hat to the head. Not only are hat pins a potentially dangerous solution, they may also be uncomfortable for the wearer. Blowing wind or an unplanned hat removal could pull the wearer's hair.

Some hats have an elastic band integrated into the hat that allows the hat to grip the wearer's head. Differences in head sizes may alter the effectiveness of this solution. The hat may fit too tightly on a wearer with a large head, while a wearer with a smaller head might not have an adequate fit.

All of these sizing solutions may fail if a particular hat also incorporates a rigid brim. In strong winds, rigid brims create a wing-like surface, which may generate enough lift to overcome any of the above-mentioned means for securing the hat to the head. Not only is hat loss embarrassing for the wearer, it is also expensive. Many hats have been blown into rivers and lakes; never to be seen again.

Hats also typically require special cleaning. Often hats must be dry cleaned or placed in special holders before washing. After being cleaned several times, the fabric tends to separate and bubble up, especially on the brim. Some hats attempt to compensate for this by adding numerous stitches in the brim to reduce the effect of water and cleaning on the brim.

There is, therefore, a need for a hat that is wind-resistant, washable and resilient.

SUMMARY OF THE INVENTION

In one embodiment of the present invention, the hat comprises a top, a band and a brim. The band has an upper portion and a lower portion, the upper portion of the band is attached to the perimeter of the top. The brim is attached to the lower portion of the band. The brim comprises a fusing material disposed between a first brim layer and a second brim layer to bond the first brim layer to the second brim layer.

In another embodiment of the present invention, the hat comprises a top, a top lining, a band lining having an upper portion and a lower portion, a band having an upper portion and a lower portion, a brim, a brim binding, and an adjustable sash or leather band. The upper portion of the band is attached to the perimeter of the top, the perimeter of the top lining and the upper portion of the band lining. The brim is attached to the lower portion of the band and the lower portion of the band lining. The brim comprises a fusing material disposed between a first brim layer and a second brim layer to bond the first brim layer to the second brim layer. A brim binding is folded over the perimeter of the first and second brim layers and attached to the first and second brim layers. The adjustable sash or leather band is disposed around the band.

The present invention also provides a method of manufacturing a hat. The method comprises the steps of attaching an upper portion of a band to the perimeter of a top, bonding a first brim layer to a second brim layer using a fusing material disposed between the first brim layer and the second brim layer, and attaching the bonded first and second brim layers to a lower portion of the band.

Other features and advantages of the present invention shall be apparent to those of ordinary skill in the art upon reference to the following detailed description taken in conjunction with the accompanying drawings.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts that may be embodied in a wide variety of specific contexts. The specific embodiments discussed herein are merely illustrative of specific ways to make and use the invention and do not delimit the scope of the invention.

Figure 1:
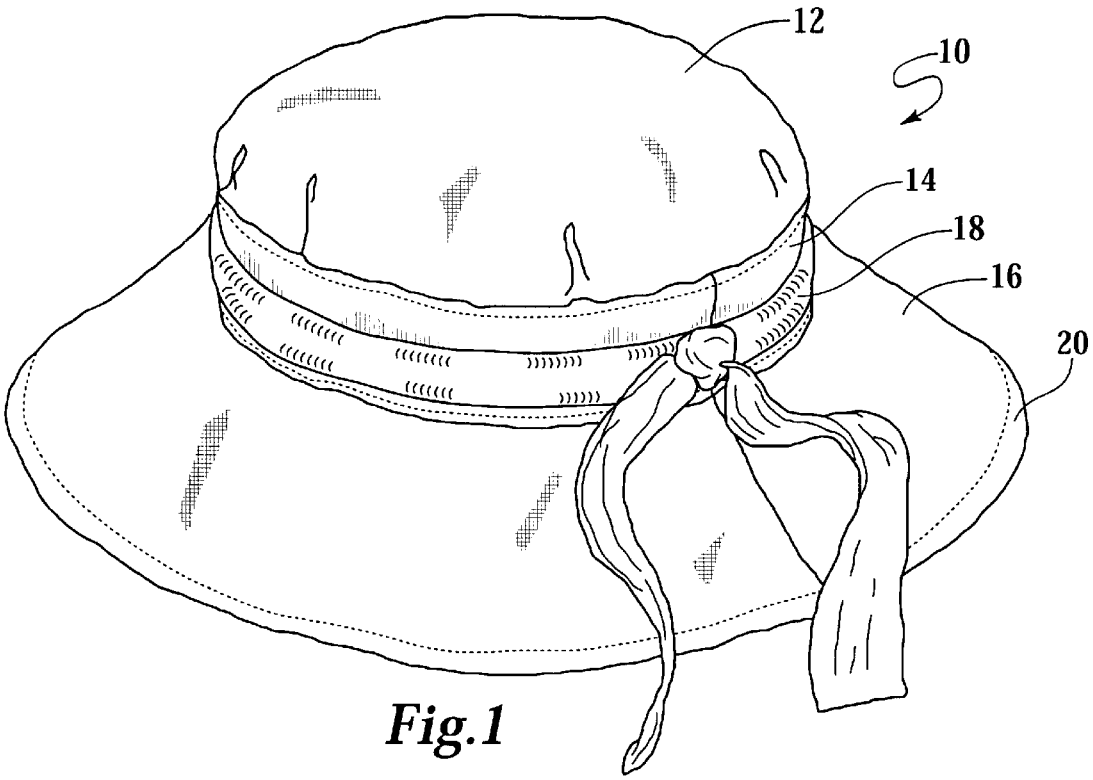
FIG. 1 is a perspective view of a hat in accordance with the present invention.

A perspective view of a hat 10 in accordance with the present invention is shown in FIG. 1. As will be described below in more detail, the hat 10 of the present invention is wind-resistant, washable and resilient. The hat 10 comprises a top 12, a band 14 and a brim 16. An adjustable sash or leather band 18 may also be used to adjust the size of the hat 10 and to increase the aesthetic appearance of the hat 10. A brim binding 20 may be used around the perimeter of the brim 16 to add durability and prevent fraying.

The brim 16 deforms slightly as gusts of wind impinge upon brim 16. Deformation of brim 16 absorbs some of the impact from the wind. The deformation also prevents brim 16 from acting as a wing and lifting the hat 10 from the wearer's head. These qualities allow hat 10 to remain on the wearer's head during windy conditions.

Figure 2:
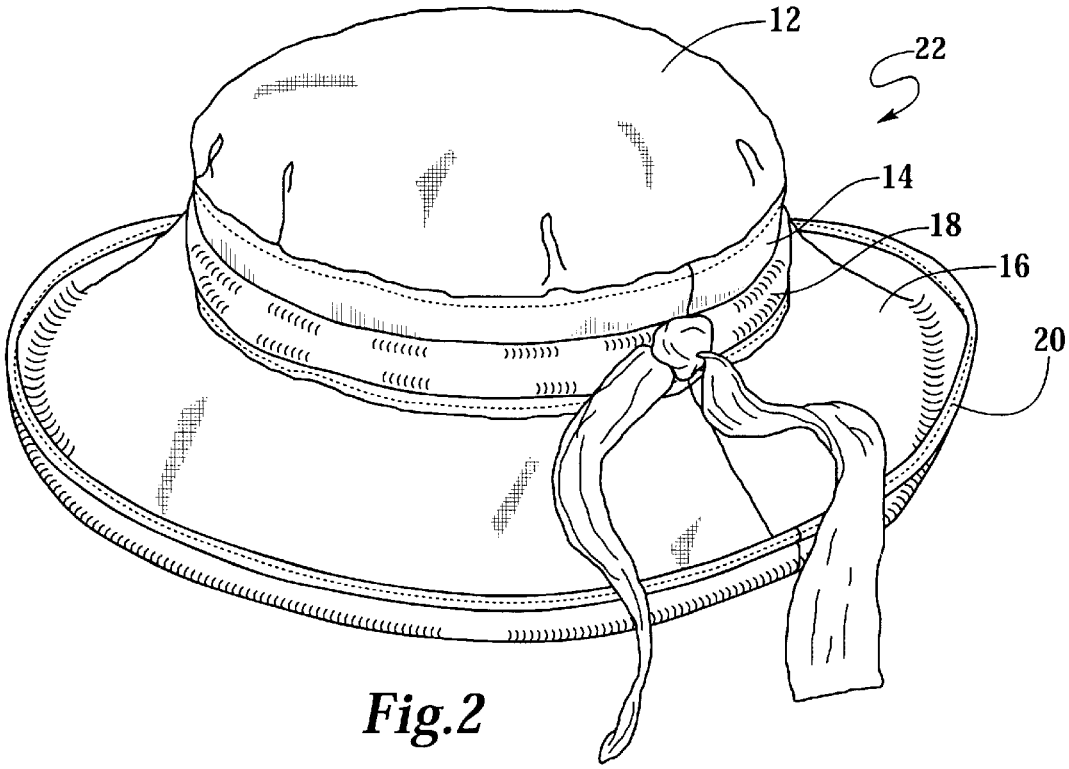
FIG. 2 is a perspective view of a hat in accordance with the present invention wherein the brim is turned up around the edges.

The brim 16 also has inherent resilience, which allows the hat 10 to retain its smooth appearance. Hat 10 may be folded, packed or crushed for storage. The hat 10 may be formed back to its original shape after hat 10 has been removed from storage. Brim 16 may also be formed into other shapes according to a desired fashion. For example, the hat 22 will hold its shape when the brim 16 is turned up around the edges as illustrated in FIG. 2. Similarly, the hat 24 will hold its shape when the brim 16 is turned up in the shape similar to a cowboy hat as illustrated in FIG. 3.

Figure 3:
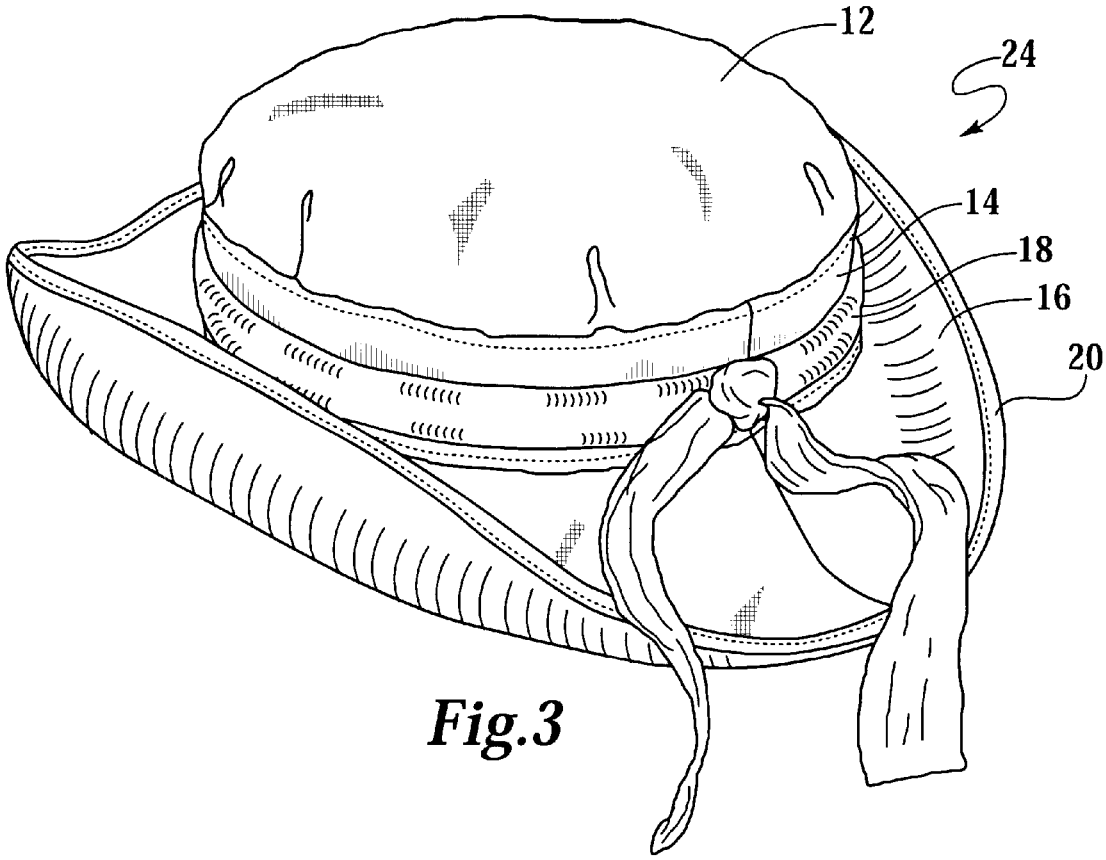
FIG. 3 is a perspective view of a hat in accordance with the present invention wherein the brim is turned up in the shape similar to a cowboy hat.

Referring to FIGS. 1, 2, and 3, the hat 10, 22 and 24 has a top 12 attached to a band 14 that generally fits over a wearer's head. The top 12 and band 14 may be manufactured in several sizes, e.g. small, medium or large, to fit a variety of wearers. The top 12 and band 14 may be made from canvas, cotton duck, corduroy, check, dobbies, denim, flannel, linen, linen blends, plaids, poplin, twills, ultra suede, waxed cloth, wool, wool blends, or any other material suitable for making this type of hat. The top 12 and band 14 may have a top liner 26 (FIG. 4) and a band liner 28 (FIG. 4) made from a lighter-weight material. The top liner 26 (FIG. 4) and the band liner 28 (FIG. 4) may function to insulate the wearer's head from the weather and they may also be decorative. The wearer may also turn hat 10, 22, 24 inside-out for reversible versatility. In such a case, the top liner 26 (FIG. 4) functions as the top 12 and the band liner 28 (FIG. 4) functions as the band 14, which allows the wearer to achieve a different look with a single hat 10, 22, 24.

In one embodiment, a canvas, such as a 10-ounce 100% cotton scoured canvas manufactured by Twin Dragon Manufacturing, Inc., may be used for the top 12, band 14, first brim layer 30 (FIGS. 5 and 7), second brim layer 34 (FIGS. 5 and 7), and brim binding 20. Fabric construction is 70 times (warp top to bottom) and 40 times (filling side to side) with 10×7 yarn size. Scouring means that the material has been through a process to take out the resin and starch out of the fibers and then put on a finishing frame to put the sizing back into the fabric. This process also pre-shrinks the fabric. This quality of canvas is not stiff but has a soft feel, which allows it to be crushed, packed or washed and retaining its shape quickly.

A brim 16 may be stitched to band 14 to protect the wearer from sun or rain. Brim 16 is shown as a continuous element around the circumference of band 14. Other embodiments, however, are contemplated. For example, brim 16 may only extend around a front portion of hat 10, 22, 24 to protect the wearer's eyes from sunlight.

An adjustable sash 18 may be tied around the circumference of band 14 to secure hat 10, 22, 24 to the wearer's head. Sash 18 may be loosely tied around band 14 during fair weather. In this configuration sash 18 is decorative and allows hat 10, 22, 24 to be loose-fitting and optimally comfortable. A loosely tied sash 18 also allows for the greatest amount of ventilation for the wearer's head. The sash 18 may be different cotton and/or polyester blends of checks, plaids, dots or various patterns to accent the hat 10, 22, 24. The sash 18 may also be an adjustable leather band.

As the weather changes and wind increases, the sash 18 may be more tightly tied around band 14. In this configuration, sash 18 compresses and gathers band 14 to more securely fasten the hat 10, 22, 24 to the wearer's head. Tightening the sash 18 helps prevent wind from blowing hat 10, 22, 24 off the wearer's head.

Figure 4:
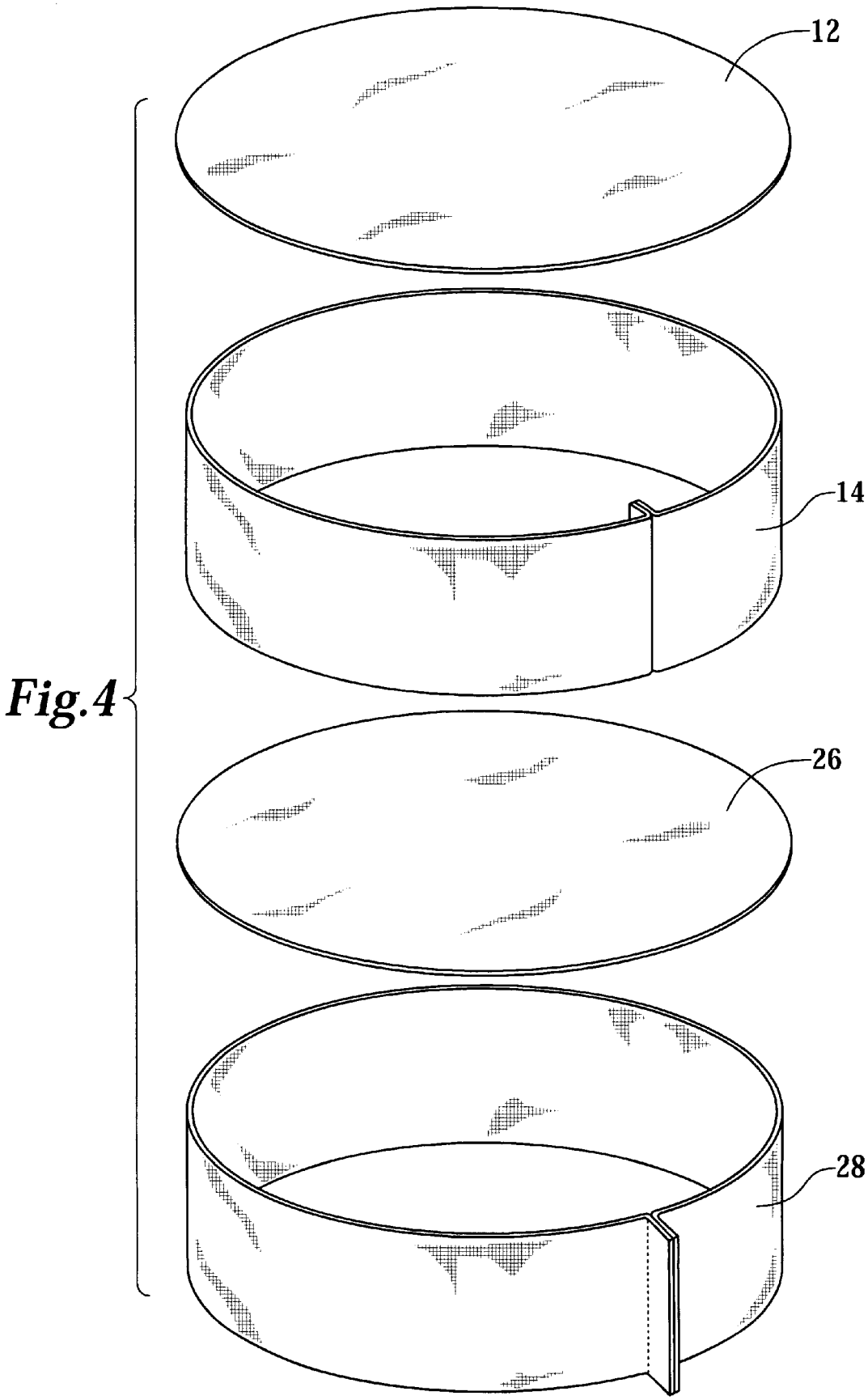
FIG. 4 is an exploded perspective view of the materials forming the top and band of the hat of FIGS. 1, 2 and 3.

FIG. 4 is an exploded perspective view of the materials forming the top 12 and band 14 of the hat 10, 22, 24 of FIGS. 1, 2 and 3. The top 12 and top lining 26 are substantially circular or ellipse shaped pieces of material. The band 14 and the band lining 28 are two narrow elongated strips of material formed into loops. The top lining 26 and band lining 28 are typically a 1005 printed cotton that provides an attractive appearance when the hat is reversed. The top lining 26 and band lining 28 may also include insulating material to retain heat during cold conditions.

Figure 5:
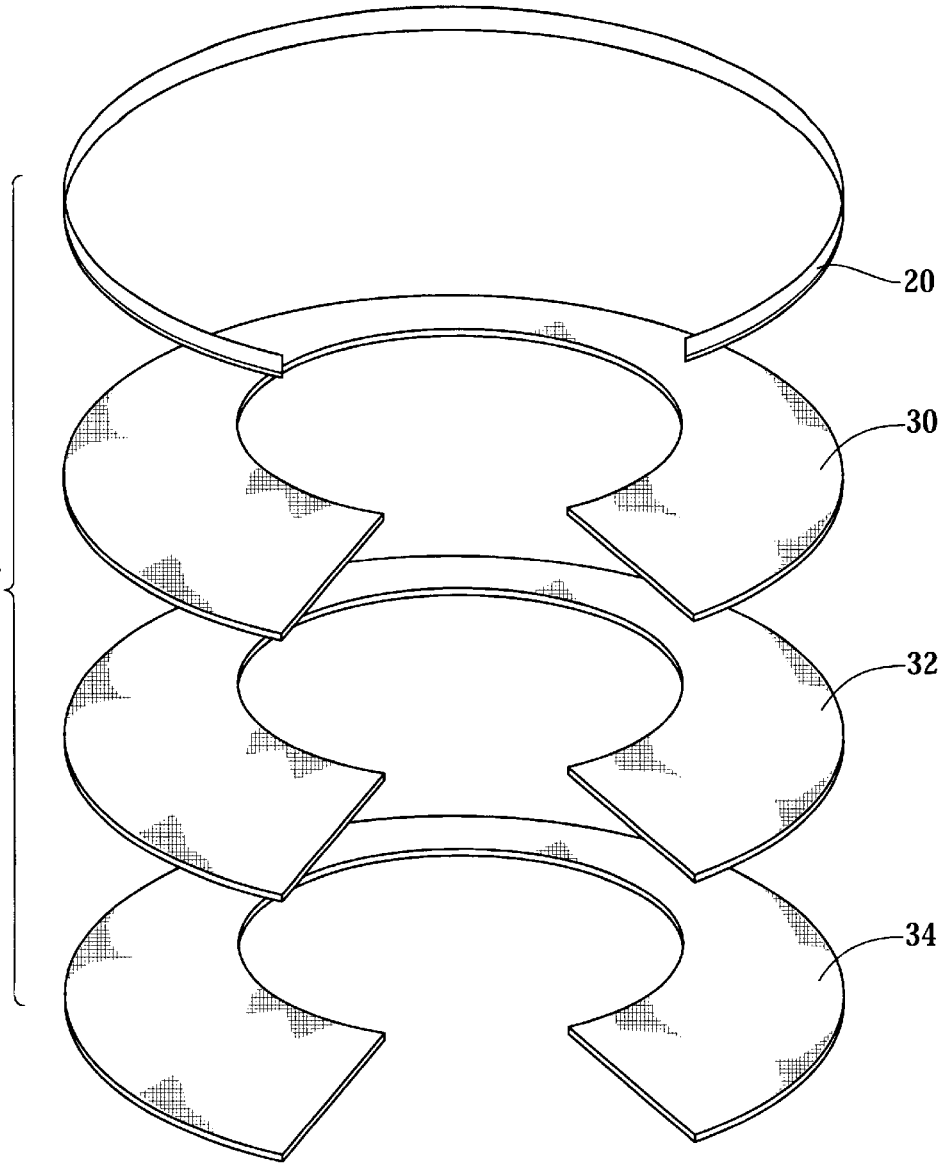
FIG. 5 is an exploded perspective view of the materials forming the brim of the hat of FIGS. 1, 2 and 3.

FIG. 5 is an exploded perspective view of the materials forming the brim 16 of the hat 10, 22, 24 of FIGS. 1, 2 and 3. The brim 16 comprises a first brim layer 30, a fusing material 32 and a second brim layer 34. The first and second brim layers 30, 34 may be made from canvas, cotton duck, corduroy, check, dobbies, denim, flannel, linen, linen blends, plaids, poplin, twills, ultra suede, waxed cloth, wool, wool blends, or any other materials suitable for this type of hat construction. The brim 16 may also include a brim binding 20 around the edge of brim 16. Brim binding 20 may serve to protect the edge of brim 16 and also to give hat 10, 22, 24 a finished appearance.

The fusing material 32 may be polyester or other suitable material that will bond the first and second brim layers 30, 34 together. One such fusing material 32 is SP20 manufactured by Freudenberg South. The first and second brim layers 30, 34 are fused together using the fusing material 32 by applying approximately 260 degrees of heat for approximately 8 to 10 seconds. The exact temperature and during of the bonding process will vary depending on the fusing material 32 used. The fusing material 32 may be polyester or other suitable material that will bond the first and second brim layers 30, 34 together. One such fusing material 32 is SP20 manufactured by Freudenberg South. The first and second brim layers 30, 34 are fused together using the fusing material 32 by applying approximately 260 degrees of heat for approximately 8 to 10 seconds. The exact temperature and during of the bonding process will vary depending on the fusing material 32 used. The fusing material 32 melts and slightly penetrates the surfaces of the two fabrics 30, 34 to bond them together. The bond between brim layers 30, 34 and fusing material 32 strengthens as fusing material 32 cools. The fused brim layers 30, 34 form a brim 16 that is semi-rigid and resilient.

The fusing material 32 allows the brim 16 to be semi-rigid to allow the brim 16 to be shaped in several ways and hold the shape. The fusing material 32 also allows the hat 10, 22, 24 to be flexible so that the wind does not blow it off. Brim 16 deforms slightly as gusts of wind impinge upon brim 16. Deformation of brim 16 absorbs some of the impact from the wind. The deformation also prevents brim 16 from acting as a wing and lifting hat 10, 22, 24 from the wearer's head. These qualities allow hat 10, 22, 24 to remain on the wearer's head during windy conditions.

The fused brim 16 also has inherent resilience, which allows hat 10, 22, 24 to retain its smooth appearance. Hat 10, 22, 24 may be folded, crushed or packed for storage. The resilient fused brim 16 may be formed back to its original shape after hat 10, 22, 24 has been removed from storage. As illustrated by FIGS. 2 and 3, the brim 16 may be formed into other shapes according to a desired fashion.

Moreover, the fused brim 16 can be washed or cleaned without having the fabric separate or bubble up because the layers are bonded together instead of being stitched together. Thus, the hat 10, 22, 24 is durable and ideal for outdoor activities it will not be ruined by dirt, water, sweat or rain.

Figure 7:
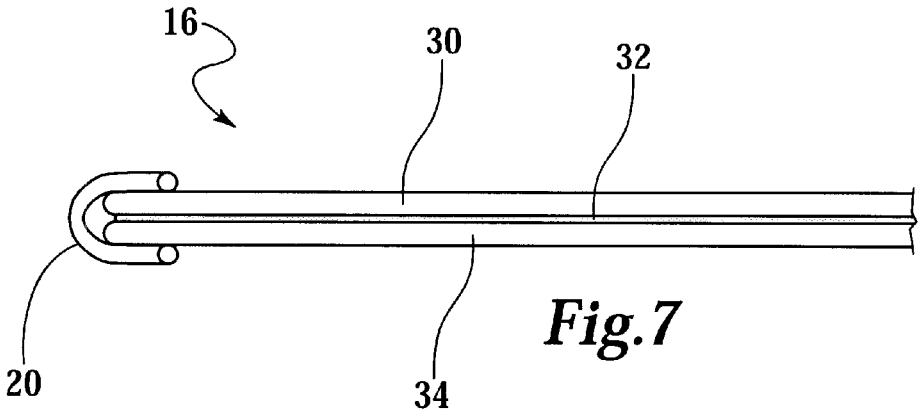
FIG. 7 is a partial cross-sectional view of the brim of the hat of FIG. 6.
Figure 6:
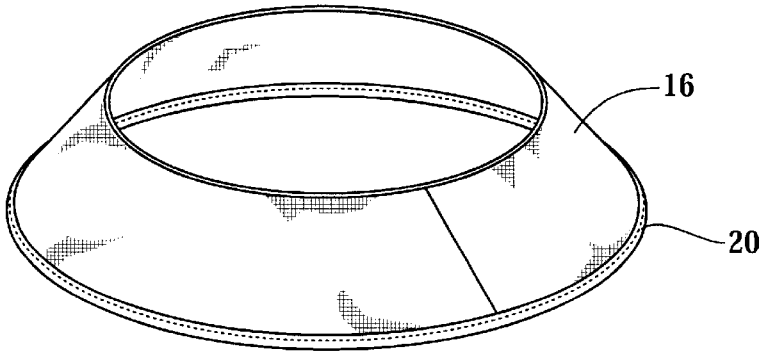
FIG. 6 is a perspective view of the brim of the hat of FIGS. 1, 2 and 3 after the materials of FIG. 5 have been assembled.

FIG. 6 is a perspective view of the brim 16 of the hat 10, 22, 24 of FIGS. 1, 2 and 3 after the materials of FIG. 5 have been assembled. FIG. 7 is a partial cross-sectional view of the brim 16. As described in reference to FIG. 5, brim 16 has a first brim layer 30 that is bonded to a second brim layer 34 using a fusing material 32.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A hat, comprising:

a top;

a top lining;

a band having an upper portion and a lower portion, the upper portion of the band attached to the perimeter of the top;

a band lining having an upper portion and a lower portion;

the perimeter of the top lining and the upper portion of the band lining attached to the perimeter of the top and the upper portion of the band;

a brim attached to the lower portion of the band, the brim comprising a fusing material disposed between a first brim layer and a second brim layer to bond the first brim layer to the second brim layer; and the lower portion of the band lining attached to the lower portion of the band and the brim.

2. The hat as recited in claim 1 wherein the hat is reversible.

3. The hat as recited in claim 1 wherein the hat is washable.

4. The hat as recited in claim 1 wherein the top, band, first brim layer and second brim layer are canvas.

5. The hat as recited in claim 1 wherein the top, band, first brim layer and second brim layer are fabrics selected from the group consisting of cotton duck, corduroy, check, dobbies, denim, flannel, linen, linen blends, plaids, poplin, twills, ultra suede, waxed cloth, wool and wool blends.

6. The hat as recited in claim 1 wherein the fusing material comprises polyester.

7. The hat as recited in claim 1, further comprising a brim binding folded over the perimeter of the first and second brim layer and attached to the first and second brim layer.

8. The hat as recited in claim 1, further comprising an adjustable sash disposed around the band.

9. The hat as recited in claim 8, wherein the adjustable sash is an adjustable leather band.

10. A hat, comprising:

a top;

a top lining;

a band lining having an upper portion and a lower portion;

a band having an upper portion and a lower portion, the upper portion of the band attached to the perimeter of the top, the perimeter of the top lining and the upper portion of the band lining;

a brim attached to the lower portion of the band and the lower portion of the band lining, the brim comprising a fusing material disposed between a first brim layer and a second brim layer to bond the first brim layer to the second brim layer, and a brim binding folded over the perimeter of the first and second brim layer and attached to the first and second brim layer; and an adjustable sash disposed around the band.

11. The hat as recited in claim 10 wherein the hat is reversible.

12. The hat as recited in claim 10 wherein the hat is washable.

13. The hat as recited in claim 10 wherein the top, band, first brim layer and second brim layer are canvas.

14. The hat as recited in claim 10 wherein the top, band, first brim layer and second brim layer are fabrics selected from the group consisting of cotton duck, corduroy, check, dobbies, denim, flannel, linen, linen blends, plaids, poplin, twills, ultra suede, waxed cloth, wool and wool blends.

15. The hat as recited in claim 10 wherein the fusing material comprises polyester.

16. The hat as recited in claim 10 wherein the adjustable sash is an adjustable leather band.

17. A method of manufacturing a hat, the method comprising the steps of:

attaching an upper portion of a band to the perimeter of a top;

attaching the perimeter of a top lining and an upper portion of a band lining to the perimeter of the top and the upper portion of the band;

bonding a first brim layer to a second brim layer using a fusing material disposed between the first brim layer and the second brim layer;

attaching a lower portion of the band lining to the lower portion of the band and the bonded first and second brim layers; and attaching the bonded first and second brim layers to a lower portion of the band.

18. The method as recited in claim 17, wherein the step of bonding the first brim layer to the second brim layer using the fusing material disposed between the first brim layer and the second brim layer comprises the steps of:

placing the fusing material between the first brim layer and the second brim layer; and heating the fusing material until the fusing material bonds the first brim layer to the second brim layer.

19. The method as recited in claim 17, further comprising the steps of:

folding a brim binding over the perimeter of the first and second brim layer; and attaching the brim binding to the first and second brim layers.

20. The method as recited in claim 17, further comprising the step of placing an adjustable sash around the band.

21. The method as recited in claim 20 wherein the adjustable sash is an adjustable leather band.

* * * * *